US005502471A

United States Patent [19]

Obermeier et al.

[11] Patent Number: 5,502,471

[45] Date of Patent: Mar. 26, 1996

[54] SYSTEM FOR AN ELECTROTHERMAL INK JET PRINT HEAD

[75] Inventors: Ernst Obermeier, Berlin; Joachim Heinzl, München; Peter Krause, Frankfurt an der Oder; Bernhard Hochwind, München; Alfred Zollner, Eitting, all of Germany

[73] Assignee: Eastman Kodak Company, Rochester, N.Y.

[21] Appl. No.: 54,537

[22] Filed: Apr. 28, 1993

[30] Foreign Application Priority Data

Apr. 28, 1992 [DE] Germany ..... 42 14 555.4

[51] Int. Cl.[6] ..... B41J 2/05

[52] U.S. Cl. ..... 347/65; 347/94

[58] Field of Search ..... 347/63, 47, 87, 347/86, 94, 65

[56] References Cited

U.S. PATENT DOCUMENTS

| | | | |
|---|---|---|---|
| 4,158,847 | 6/1979 | Heinzl | 347/68 |
| 4,680,595 | 7/1987 | Cruz-Uribe | 347/68 |
| 4,847,630 | 7/1989 | Bhaskar | 347/63 |
| 4,929,969 | 5/1990 | Morris | 347/63 X |
| 4,980,703 | 12/1990 | Sakurai | 347/63 |
| 5,016,024 | 5/1991 | Lam | 347/63 |
| 5,211,806 | 5/1993 | Wong | 156/644 |

FOREIGN PATENT DOCUMENTS

| | | | |
|---|---|---|---|
| 91/17891 | 11/1991 | WIPO | B41J 2/05 |

*Primary Examiner*—Joseph W. Hartary
*Attorney, Agent, or Firm*—Milton S. Sales

[57] ABSTRACT

An electrothermal ink jet print head is constructed in layer structure, wherein the expansion direction of the ink vapor bubble is directed opposite to the ink-ejection direction. Each ink channel (16) of the ink jet print head is supplied with ink by flow throttles for a highest degree of effectiveness. For this purpose, a cover plate (1) is furnished with openings (2). The openings (2) join into an ink storage container. The openings (2) are connected with recess openings (25) to the ink channel (16) in the chip (11). Selectively, the recess openings (25) can be furnished in the chip (11) or in the cover plate (1). A method is provided for producing the recess openings (25).

11 Claims, 9 Drawing Sheets

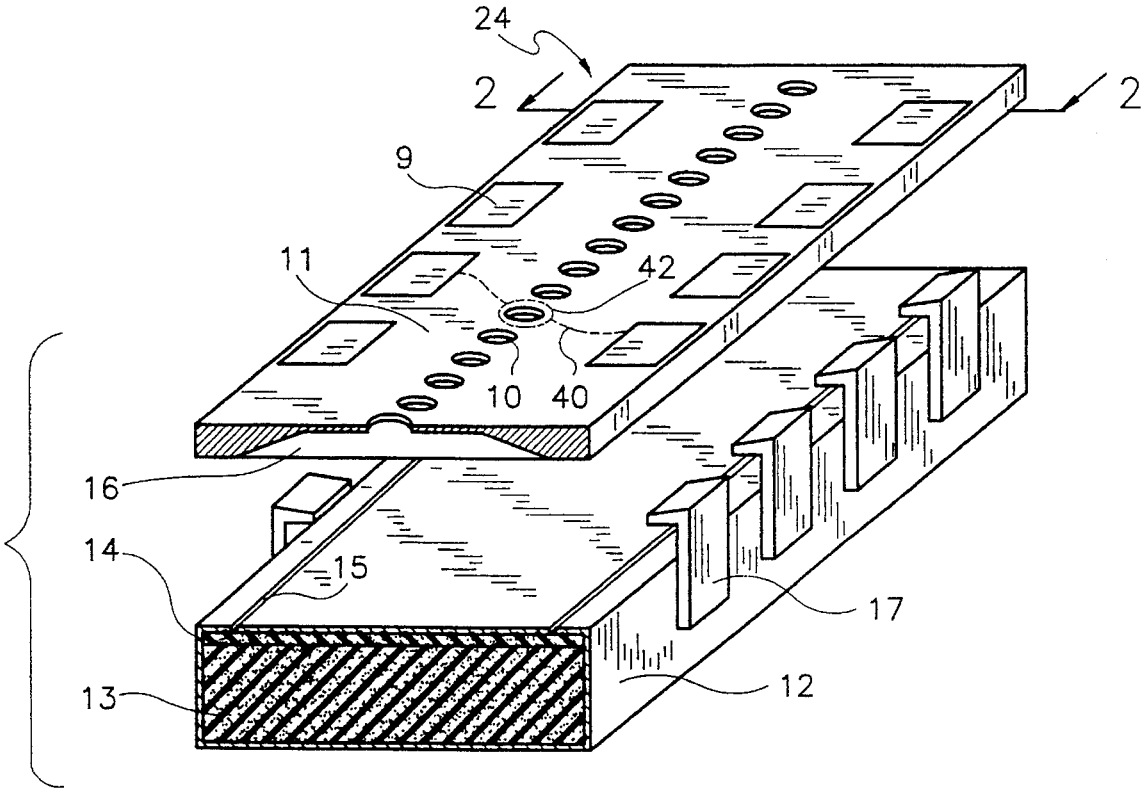
Fig.1 *PRIOR ART*
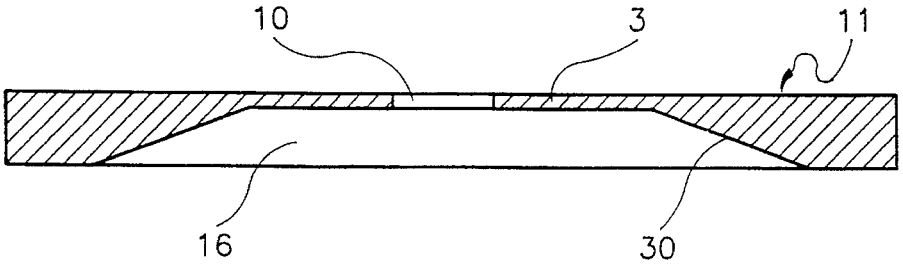
Fig.2 *PRIOR ART*

SYSTEM FOR AN ELECTROTHERMAL INK JET PRINT HEAD

BACKGROUND OF THE INVENTION

1. Field of the Invention

The invention relates to a system and arrangement for an electrothermal ink jet print head in a layer construction, where the extension direction of the electrothermally generated vapor bubble is directed opposite to the ink ejection direction.

2. Brief Description of the Background of the Invention Including Prior Art

Conventional electrothermal ink jet print heads, operating according to the bubble-jet principle, exhibit plurality of individual nozzles, where individual droplets of a defined size are generated under the influence of an electronic control, and wherein individual droplets are ejected according to a defined pattern in the direction of recording substrate.

The characters to be printed are in each case generated by a plurality of ink droplets, where the ink droplets are aligned like a matrix relative to each other.

Advantageously, in each case a column of such matrix referring to a production of characters is printed simultaneously in order to meet the requirements of a high print speed and of a uniform print image and of a uniform general impression.

An ink jet print head, which is suitable for the recited print method is to combine also several like elements, which are capable to eject the ink droplets at the required point in time i.e. the ink jet print head has to operate according to the "drop-on-demand" principle. It is a characteristic feature of this technology that an electric resistor, formed as a heating element, is disposed a capillary, filled with a recording liquid, such as for example ink, and in fact in the neighborhood of an opening of the capillary. If a certain thermal energy, generated by a short current pulse, is fed to this heating element, then a rapidly expanding ink vapor bubble is initially generated based on the extremely quick thermal transfer to the ink liquid, wherein the ink vapor bubble after a discontinuation of the energy feed and after cooling by the ink liquid collapses relatively quickly into itself. The pressure wave, generated in the interior of the capillary by the vapor bubble, induces and allows an ink droplet to be ejected out of the nozzle opening onto the surface of a closely neighboring recording substrate.

It is an advantage of this bubble-jet principle that the relatively large and quick volume change, necessary for the ink ejection, can be generated by way of a very small active converter face by employing the phase change liquid-gas-liquid of the ink liquid. The small converter faces in turn allow, in the context of an application of modern and present-day production methods, such as high-precision, photolithographic processes in layering techniques to provide a relatively simple and low-cost construction of ink jet print heads, which are characterized and distinguished by a high writing and recording track density and by small dimensions.

An ink jet print head is known from the international application PCT/DE/91/00364, which ink jet print head comprises essentially a chip and an ink-storage container, where the chip is mechanically clamped and attached on the ink-storage container by way of mounting clamps. This chip exhibits ink channels which are closed on three sides and open towards the fourth side, where the ink jet channels are separated from each other by thin, substantially trapezoidal intermediate channel walls. The closure of the respective ink jet channel is made of a thin membrane in the direction of ink ejection. The thin membrane in turn exhibits the ejection nozzle of the respective ink channel. A surface of the ink-storage container furnishes the outer closure of the ink channels toward the fourth side which is open toward the chip.

If a heating element is triggered and energized for the generation of a droplet, then the heating of the heating element leads to a local overpressure in the respective ink channel in addition to the vapor bubble formation. In addition to the intended droplet ejection, this overpressure leads to a situation where a certain amount and volume of ink is pressed backwards in the direction toward the supply channels. This means that, in addition to the amount of energy, required for the ejection of the droplets, there also has to be supplied an amount of loss energy amount, where the amount of loss energy is used, among other purposes for providing a back transport of the ink after termination of ejection. This amount of loss energy decreases the overall degree of effectiveness of the ink jet print head.

In addition, the pushed-back ink volume results in a local overpressure in the supply channels and thus in an influencing of neighboring ink channels. If the neighboring ink channels of a non-triggered ink channel are triggered and thereby driven, then there can nevertheless occur an undesired droplet ejection of the non-triggered ink channel based on the generated superpositioning of pressures accumulating in the non-triggered channel.

Depending on whether neighboring ink channels of a first channel are triggered and energized or not, the pressure conditions in the first ink channel change and as result the resulting droplet volume ejected from the first channel and thus the print quality change also.

SUMMARY OF THE INVENTION

1. Purposes of the Invention

It is an object of the present invention to provide an ink jet print head, which retains the advantages of the recited ink jet print head but which exhibits at the same time a higher degree of effectiveness and which is suitable to furnish a uniformly high print quality independent of the mode of operation.

It is another object of the invention to provide a system for furnishing an ink jet print head, which allows a low-cost production of a miniaturized ink jet print unit.

It is yet another object of the present invention to increase the reliability of the operation of an ink jet print head.

These and other objects and advantages of the present invention will become evident from the description which follows.

2. Brief Description of the Invention

The present invention provides for a system for an electrothermal ink jet print head. A chip includes a plurality of ink channels with ink-discharge openings disposed on the chip. A plurality of flow throttles of a defined cross-section are disposed on the chip, with each one of the plurality of flow throttles having a first end and having a second end. Each one of the first ends of the plurality of flow throttles is connected to a respective one of the plurality of ink channels. A throughput of the flow throttle is determined by the number and size of passage openings of the flow throttle. A plurality of heating elements is disposed in the chip for transferring heat to an ink liquid for forming electrothermally generated vapor bubbles in the ink liquid. A plurality of electrical feed lines is disposed on the chip and each one of the plurality of electrical feed lines is connected to a corresponding one of the plurality of heating elements. A plurality of contact terminal locations is disposed on the chip and each one of the plurality of contact terminal locations is connected to a corresponding one of the plurality of electrical feed lines. A plurality of ink-ejection openings is disposed on the chip, wherein each one of the plurality of ink-ejection openings is connected to a corresponding one of the plurality of ink channels. Each electrothermally generated vapor bubble, formed by thermal transfer from a respective one of the plurality of heating elements, expands in a direction opposite to an ink ejection direction. An ink storage container is detachably connected to the chip. A top side of the ink storage container is disposed toward the chip and includes a supply channel formed in the surface of the ink storage container. The supply channel is connected to one of the plurality of second ends of the plurality of flow throttles. A material layer is disposed between the chip and the ink storage container. Each one of the plurality of the flow throttles is formed by the elements chip and the material layer, thereby forming a layer construction for the electrothermal ink jet print head.

The ink storage container can include a second supply channel disposed substantially parallel to the first supply channel. Preferably, the material layer is a perforated etching mask. The etching mask can form etch-mask openings. The chip can be made of silicon. Preferably, the chip further includes an etching mask for forming the ink channels. The etching mask can include a plurality of etch-mask openings for each ink channel. Preferably, the etch-mask openings give an etching agent access to the chip during the etching process. Preferably, at least a part of the etch-mask openings belonging to one ink channel is disposed in the region of the ink storage container.

The material layer can be a cover plate furnished with openings. The openings can be coordinated and connected to the supply channels. The surface of the cover plate can comprise a material selected from the group consisting of glass and silicon. Preferably, the plurality of ink channels and a plurality of connections between respective ones of the plurality of flow throttles and the supply channel are etched in the chip constituted substantially of silicon.

A method for producing an ink jet print head comprises the following steps. A silicon crystal is cut to size. An etching mask is furnished to the chip including a layer of silicon dioxide and a layer of silicon nitride. An etchstop layer is applied to a chip side disposed remote from and on an opposite side relative to the position of the etching mask. An anisotropic etching step is performed for forming in part a structure for ink channels. The etching mask is opened at locations of recesses to be formed by removing the silicon dioxide layer and the silicon nitride layer at the locations of recesses to be formed with a dry-etching process. A second anisotropic etching step is performed for the unmasked region of the chip for structuring ink channels up to an automatic etching stop. The chip can be joined with a cover plate by performing an anisotropic bonding process.

According to the present invention, each ink channel of the ink jet print head is connected through separate flow throttles with the respective supply channel, starting from a trapezoidal longitudinal ink channel section, where the ink supply is furnished with symmetrically disposed supply channels connecting at the acute angle of the trapezoidal longitudinal ink channel section, and wherein the longitudinal ink channel section extends perpendicular to the longitudinal direction of the supply channels.

For this purpose, the chip is covered on the ink-storage container side with a separate closing or cover plate. The cover plate exhibits openings between the ink supply channels of the ink-storage container and the ink channels of the chip. Recesses are furnished in one of the elements chip and cover plate, where the recesses are provided in the surface of a first element facing the second element. The recesses in the first element facing the second element are covered by the respective second element such that channel-shaped space elements are generated. These channel-shaped space elements exhibit a smaller cross-section as compared to all other space elements passed by the flowing-through ink such that the channel-shaped space elements operate as throttle channels because of their flow resistance.

The or cover plate is preferably made of glass or plastic foil.

The advantageous effect of this arrangement comprises that slow flow processes, as they occur in the filling or refilling of the ink channel, can be performed nearly unimpededly, whereas however high pressure peaks, which are generated during the vapor bubble formation, encounter an opposition by a high resistance. For example, an elastic element can provide a high resistance against the propagation of a pressure peak. Otherwise an inelastic structure will resist deformation caused by the pressure peak and induce propagation of the pressure peak.

The pressure wave, generated in the ink channel by the activation, the triggering, and the energization of the heating elements, remains substantially limited to the respective ink channel and is transformed to a larger extent to droplet ejection energy. On the one hand, this substantially increases the degree of effectiveness of the respective ink channel and, on the other hand, it advantageously decreases the influencing of neighboring ink channels by occasions in a first ink channel in an advantageous manner. The interdependence of the droplet volume and of the droplet velocity from the control of and from a triggering of neighboring ink channels is thereby minimized.

The novel features which are considered as characteristic for the invention are set forth in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

In the accompanying drawings, in which are shown several of the various possible embodiments of the present invention:

FIG. 1 is a perspective view of a principle diagram of an ink jet print head particularly suitable in connection with the present invention;

FIG. 2 is a sectional view through a chip of an ink jet print head according to FIG. 1;

FIG. 7*c* is a view of an etched ink channel seen in a direction opposite to the droplet ejection direction;

DESCRIPTION OF INVENTION AND PREFERRED EMBODIMENT

Figure 3:
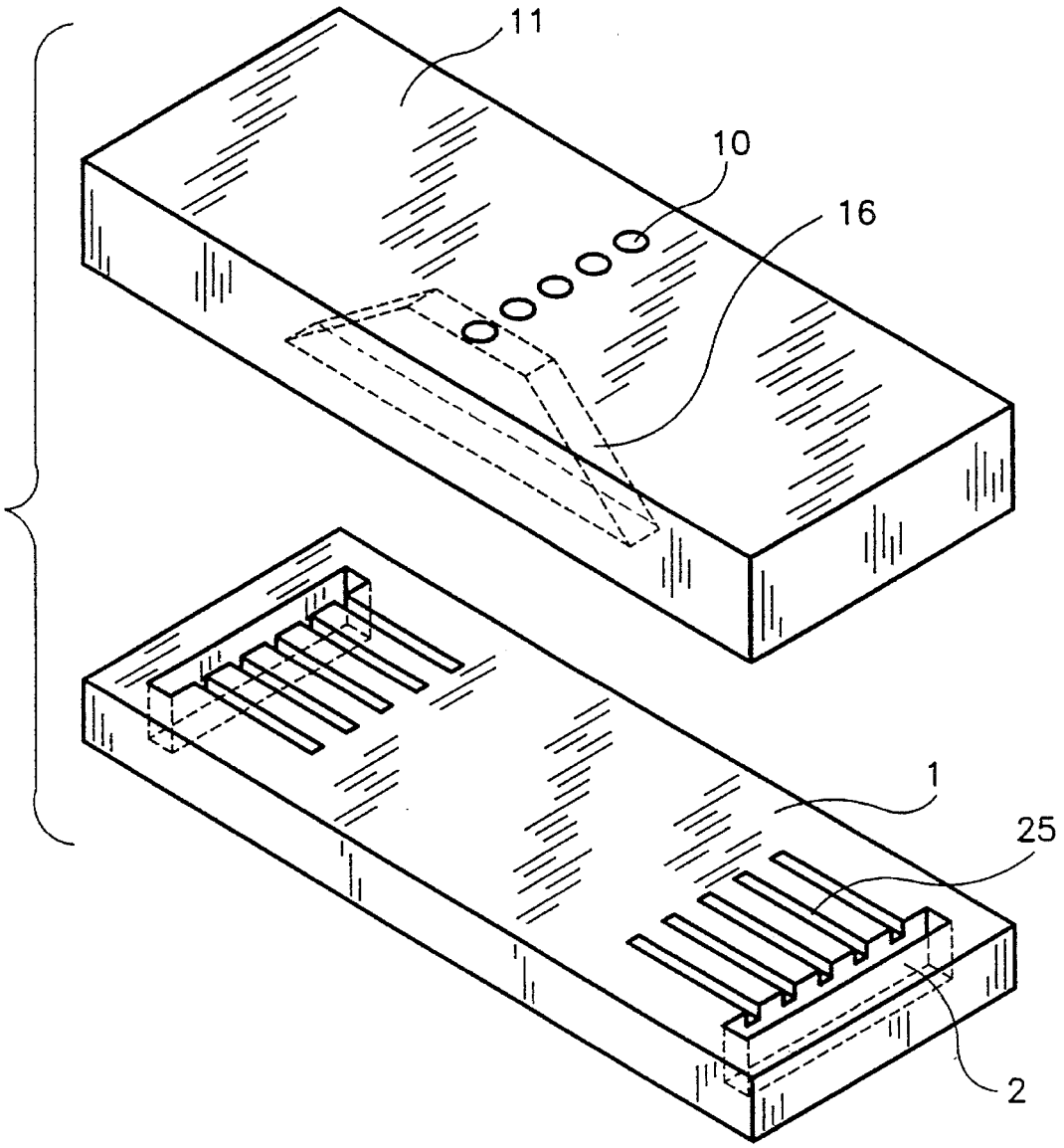
FIG. 3 is a top view of an exploded representation of an embodiment of the invention structure.

According to the present invention there is provided a system for an electrothermal ink jet print head of a layer construction with a plurality of ink channels with ink-discharge openings. Heating elements, electrical feed lines, contact terminal locations, and ink-ejection openings are combined on a single chip. Each electrothermally generated vapor bubble, formed by heat transfer from the heating element, expands in a direction opposite to an ink ejection direction. The ink jet print head is detachably connected with an ink storage container through supply channels. A top side of the ink storage container is disposed toward the chip. Each ink channel 16 of the ink jet print head 24 is connected with at least one separate flow throttle of a defined cross-section to the respective supply channel 15 formed in a surface of the ink storage container 12. A material layer is furnished between the chip and the ink storage container 12. The flow throttle is formed by the elements chip 11 and the material layer. A throughput of the flow throttle is determined by the number and size of the passage openings.

Preferably, the material layer is a perforated etching mask 18. The etching mask 18 can exhibit etch-mask openings 19. Preferably, the chip 11 is made of silicon. The chip 11 can be furnished with an etching mask 18 for forming the ink channels 16. The edging mask 18 can include a plurality of etch-mask openings 19 for each ink channel 16. The etch-mask openings 19 can give an etching agent access to the chip 11 during the etching process. Preferably, at least a part of the etch mask openings 19 belonging to one ink channel 16 is disposed in the region of the ink supply.

Preferably, the material layer is a cover plate 1 with openings 2. The openings 2 can be coordinated to the supply channels 15. The surface of the cover plate 1 can comprise a material selected from the group consisting of glass and silicon. The recess openings 25, 33 can be etched in the chip 11 made substantially of silicon.

FIG. 1 shows a perspective representation of the construction of an ink jet print head 24. The ink jet print head 24 comprises substantially only two parts to be connected to each other, i.e. a chip 11, which includes the heating elements, the electrical feed lines, and the contact positions for the electrical connection as well as the ejection openings and nozzles, and which chip 11 is attached and contacted on an ink-storage container operating as a closure of the ink-storage container. The heating elements 42, the electrical feed lines 40, the contact locations 9, and the ejection openings 10 can in this case be generated by a single chip 11, made preferably out of silicon by using planar processing steps.

The ink-storage container 12 exhibits a rectangular or parallelipipedal, box-shaped structure, wherein a medium, such as for example a sponge 13, is soaked with an ink liquid and is disposed in the ink-storage container 12. The upper side of the ink-storage container 12, disposed toward the chip 11, includes ejection openings furnished in the shape of two supply channels 15, where the two supply channels 15 include filters 14. These supply channels 15 run parallel to each other in longitudinal direction of the ink-storage container 12 such that the supply channels 15 are in flow connection with the ejection openings 10 through the ink channels 16 in a mounted and positioned state of the chip 11. The mounting of the chip 11 onto the ink-storage container is performed in a simple way by mounting brackets or mounting clamps 17, disposed along the longitudinal sides of the ink-storage container 12. The mounting brackets or the mounting clamps 17 assume both the mechanical connection as well as the electrical contacting through the contact positions 9.

FIG. 2 represents a section through a chip along the section line 2—2 in FIG. 1. In particular, the geometric/configuration/structure/ of an ink channel 16 is recognized in FIG. 1, where the structure of the ink channel 16 exhibits parallel walls with inclined discharge zones 30.

As can be further gathered from FIG. 2, this ink channel 16 is closed like a membrane on the side of the nozzle only by a thin layer of a chip substrate material. The ejection opening 10 is furnished in this membrane 3. The heating elements are disposed on the side of the membrane 3 disposed facing away from the ink channel 16.

According to a first embodiment of the invention shown in FIG. 3, the chip 11 of the ink jet print head 24, where the chip 11 includes the ink channels 16 with the ejection openings 10, is complemented and closed by a cover plate 1. The or cover plate 1 delimits and provides a boundary for the ink channels 16 relative to the ink-storage container side. The cover plate 1 exhibits recess openings 25, where the recess openings 25 are in each case connected to an opening 2 passing through the cover plate 1. The recess openings 25 are formed elongated and disposed in a longitudinal direction disposed substantially parallel to the longitudinal direction of the ink channels 16. The recess openings are grooveshaped, and disposed in parallel to each other and a part of the longitudinal extension of the recess openings 25 is covered by the chip 11. The remaining part of the longitudinal extension of the recess openings 25 is matchingly covered with a part of the ink channels 16 open toward to the cover plate 1. The recess openings 25 can have a narrower width as compared to the ink channels 16. The openings 2 are connected in the mounted and assembled state to the supply channels 15 in the ink-storage container 12.

The or cover plate 1 is preferably made of glass or plastic foil. The recess openings 25 are produced by etching or by sand blasting.

Figure 4:
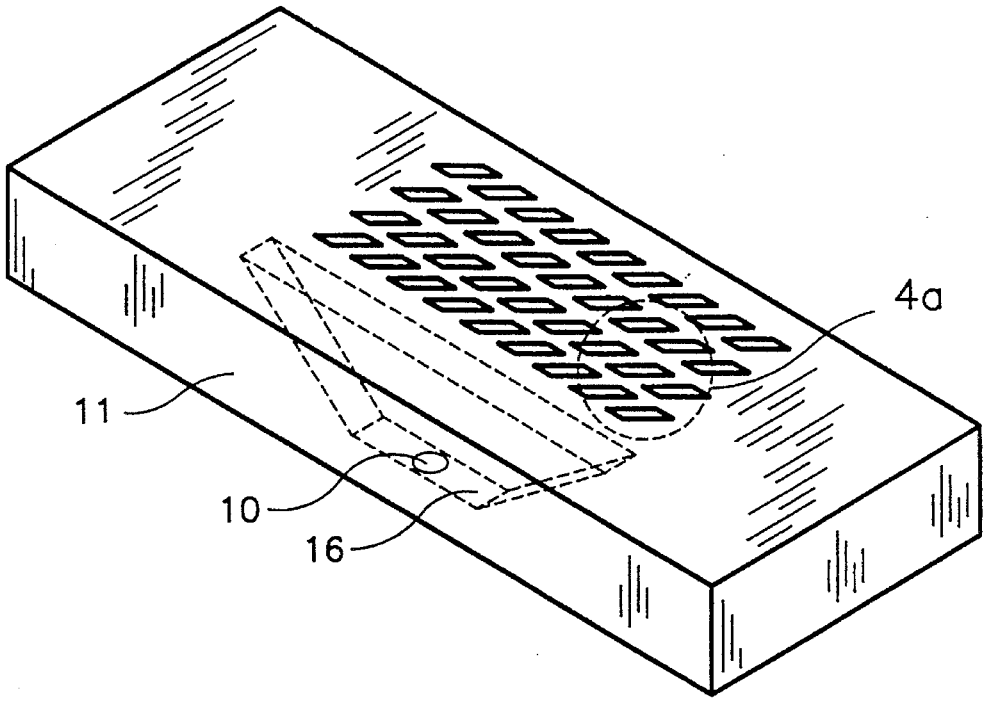
FIG. 4 is a view of a chip with an etching mask having a structure according to the present invention; and exhibiting a bottom view orientation as compared to the orientation of the view of FIG. 3.
Figure 4A:
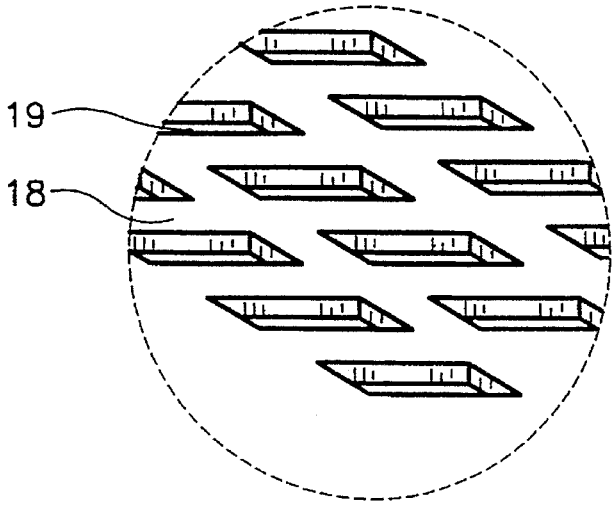
FIG. 4*a* is a partial view of the chip with the etching mask shown in FIG. 4.

According to a further embodiment or further feature of the invention, the chip 11 as shown in FIG. 4 is provided with an etching mask 18 in preparation of the etching process for the production of the ink channels 16. This etching-agent-resistant etch mask 18 exhibits openings 19.

In general, precisely one corresponding etch mask opening 19 is provided for each ink channel 16 where the etch mask opening 19 exhibits the projection geometry of the ink channel, and wherein the etching mask 18 is removed after completion of the etching process.

A plurality of etching mask openings 19 is furnished for each channel 16 according to the present invention. The mechanisms of the anisotropic etching of silicon in the 110 direction have the effect that the ink channels 16 exhibit nevertheless the same geometry as in conjunction with the conventional etching process.

The etching mask 18 remains on the top of the chip 11 according to the invention. At least one part of the etch mask openings 19, coordinated to one ink channel 16, is disposed in the region of the ink supply.

According to a first separate feature, the ink supply is furnished by the supply channels 15 in the ink-storage container 12 as shown in FIG. 1. The size and extent of the throttle action is determined by the width of the supply channels 15 as well as by the number and size of the etch mask openings 19 disposed in the region of the supply channels 15.

According to a second separate feature, the cover plate 1, according to FIG. 3, is furnished for the ink supply between the chip 11 and the ink-storage container 12. The cover plate 1 exhibits openings 2, which are coordinated to the supply channels 15 in the ink-storage container 12. Recess openings 25 are connected to the openings 2, where the recess openings 25 are coordinated to the ink channels 16 in the chip 11. The size of the throttling effect is determined by the number and the size of the etch mask openings 19 disposed in the region of the recess openings 25.

Figure 5A:
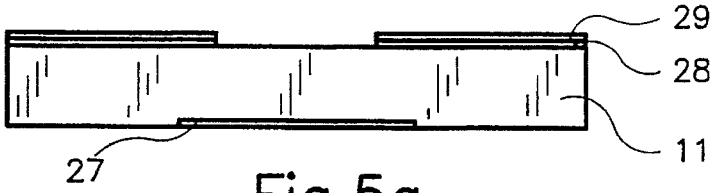
FIG. 5*a* is a schematic sectional view of a first process steps for generating throttle channels in a chip.
Figure 5B:
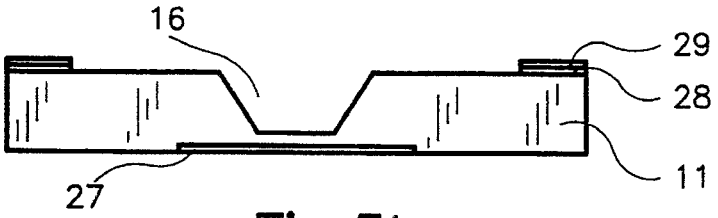
FIG. 5*b* is a schematic sectional view of a second process steps for generating throttle channels in a chip.
Figure 5C:
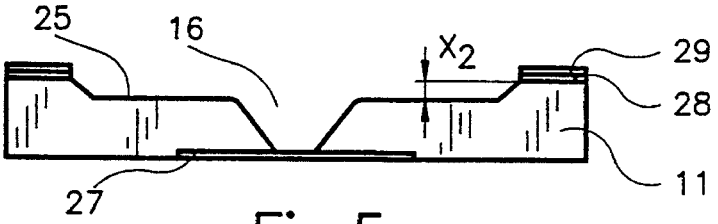
FIG. 5*c* is a schematic sectional view of a third process steps for generating throttle channels in a chip.

Successive processing steps of the chip 11 are illustrated in FIGS. 5*a*–5*c*. In this context, FIG. 5*a* shows a sectional view through the chip 11 in longitudinal direction of the ink channel to be formed. The chip 11 is furnished with an etching mask, including a layer of silicon dioxide 28 and a layer of silicon nitride 29. The silicon nitride layer 29 and the silicon dioxide layer 28 are open in the area of the ink channel to be formed. An etch-stop layer 27 is furnished at the chip side disposed opposite to the etching mask.

Subsequently, a first, anisotropic etching step is performed for the partial structure formation of the ink channels. The ink channels 16 are laid open in this step up to a predetermined depth x1 as shown in FIG. 6*b*. In a subsequent step, the etching mask is opened at the locations of the recesses 25 to be formed. For this purpose, the silicon nitride layer 29 and the silicon dioxide layer 28 are removed at the predetermined locations with the aid of a dry-etching process. The then following process step is shown in FIG. 5*b*. The ink channel 16 is shown for a depth x1, where the surroundings or neighborhood of the ink channel 16 is freed in longitudinal direction of the nitride layer 29 and of the silicon dioxide layer 28. The depth x1 of the ink channel 16 has not yet reached the etching-stop layer 27, according to FIG. 5*b*.

Subsequently, there is performed a second anisotropic etching stop with the etching depth x2 for the entire, unmasked region of the chip 11 as shown in FIG. 5*c*. In this second anisotropic etching step, the ink channels 16 are structured up to the automatic etching stop 27. The etching depth x2, shown in FIG. 5*c*, determines the cross-section face of the recess openings 25, wherein the widths of the openings in the etching mask are predetermined.

The processing state of the chip 11 according to the second anisotropic etching step is shown in FIG. 5*c*. The structuring of the ink channel 16 reaches up to the etching stop 27 and the recesses 25 exhibit a depth x2.

Figure 6A:
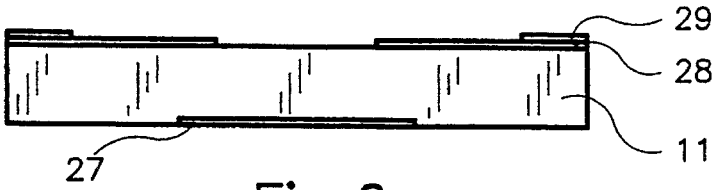
FIG. 6*a* is a further representation of a first process steps for generating throttle channels in a chip.
Figure 6B:
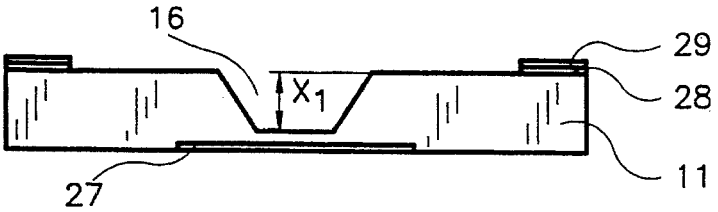
FIG. 6*b* is a further representation of a second process steps for generating throttle channels in a chip.

According to a further feature of the structuring process of manufacturing according to FIGS. 5*a*–5*c*, in preparation of the first anisotropic etching step according to FIG. 6*a*, the silicon nitride 29 layer is opened both for forming the ink channels 16 as well as for forming the recess openings 25. The silicon dioxide layer 28 is open only for the ink channels 16. The etching stop layer 27 is applied and placed at the side of the chip 11 disposed opposite to the etching mask.

During the first anisotropic etching step, according to FIG. 6*b*, the ink channel 16 is etched and formed with an etching depth x1 and, simultaneously, the original silicon dioxide layer 28 in the region of the recess openings 25 is removed up to a residual silicon dioxide layer 31.

The residual silicon dioxide layer 31 is removed prior to a second anisotropic etching step.

Figure 6C:
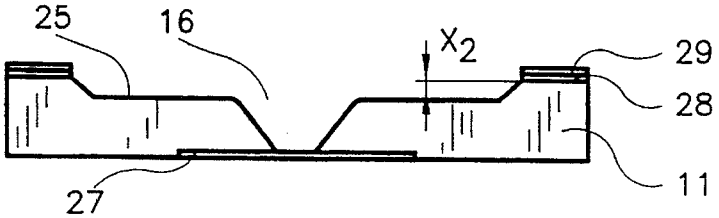
FIG. 6*c* is a further representation of a third process steps for generating throttle channels in a chip.

During a second anisotropic etching step, the recess openings 25 are etched and formed to an etching depth x2, and the ink channels 16, according to FIG. 6*c*, are advanced up to the etching stop layer 27 in case these ink channels 16 have not yet reached the etching stop layer 27 in the first etching step.

Figure 7A:
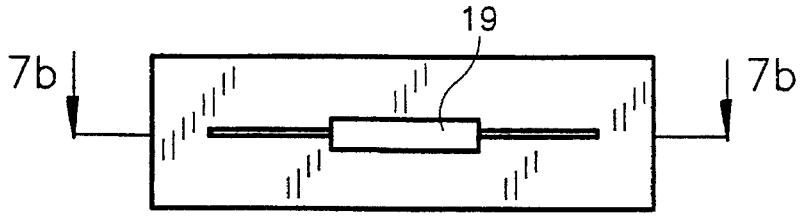
FIG. 7*a* is a schematic top plan view of a production of an etching mask for an ink channel.

According to a further feature of the present invention, an etch mask opening 19 is worked into the etching mask according to FIG. 7*a*, comprising an oxide layer 28 and a nitride layer 29, such that both faces, the face for the ink channel 16 to be formed and structured, as well as the face for the recess openings 25, are freed and open for access.

Figure 7B:
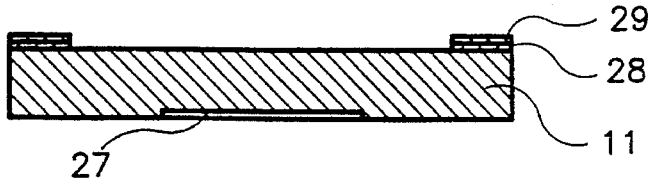
FIG. 7*b* is a schematic sectional view of a chip, ready for etching, along section line 7*b*—7*b* of FIG. 7*a;*

A sectional view through the chip 11 along the section line 7*b*—7*b* of FIG. 7*a*, is shown in FIG. 7*b*, where FIG. 7*b* shows the position of the nitride layer 29 and of the oxide layer 28 on the chip 11. The etch stop layer 27 is provided on the side of the chip 11 which is disposed opposite relative to the etching mask.

Figure 7C:
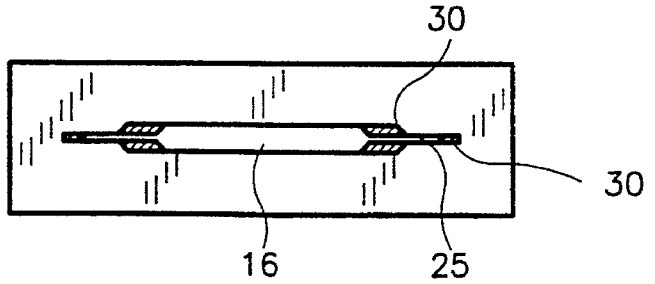
FIG. 7*c* is a top plan view of an etched ink channel as seen in a droplet ejection direction.

The processing state of the chip 11 after the anisotropic etching is represented in FIG. 7*c* as a plan view from the side of the etch mask. The ink channel 16 and the recess openings 25 exhibit the same depth. The recess openings 25 and the ink channel 16 are both delimited in longitudinal direction by bevelled discharge zones 30.

The reducing and delimiting effect for the ink flow is dimensioned and configured based on the width of the recess openings 25.

Figure 10A:
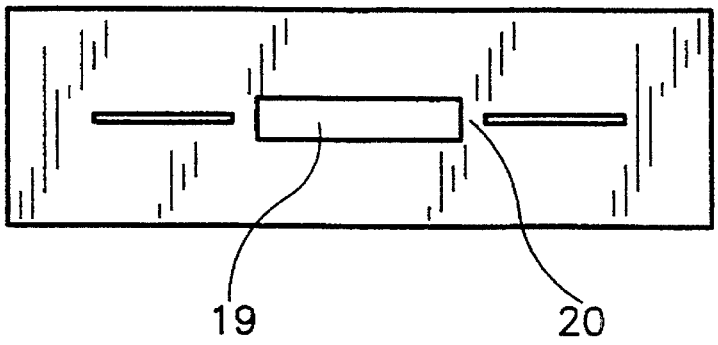
FIG. 10*a* is a schematic top plan view of an etching mask for an ink channel.

According to a further feature of the invention, the etching mask, according to FIG. 10*a*, is furnished with three etch-mask openings 19 for each ink channel, wherein the etch-mask openings 19 are separated from each other by webs 20.

The etch-mask openings 19 are disposed successively and in series in longitudinal direction. The center etch-mask opening 19 is wider than the two neighboring etch-mask openings. The center etch-mask opening serves to providing the structure of the ink channel. The recesses in the chip 11 are formed by the neighboring narrow etch-mask openings 19.

Figure 10B:
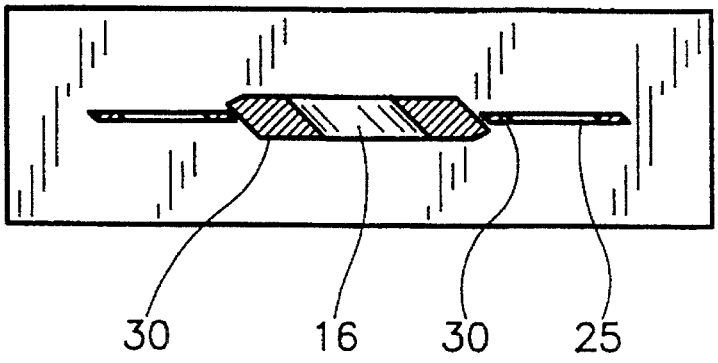
FIG. 10*b* is a view of a partially etched structure or an ink channel.

The ink channels 16 and the recess openings 25 are simultaneously fabricated from the chip 11 by anisotropic etching. For this purpose a processing state during the etch process is illustrated in FIG. 10*b*. The actual distance of the ink channel 16 relative to the recess openings 25 is decreased with increasing etching time based on an underetching of the webs 20 with bevelled edge zones and discharge zones 30 as shown in FIG. 10*b*.

The width of the webs 20 is dimensioned such that they are underetched shortly before termination of the etching process, to such extent that a connection is generated between the ink channel 16 and the respective recess openings 25.

Figure 9:
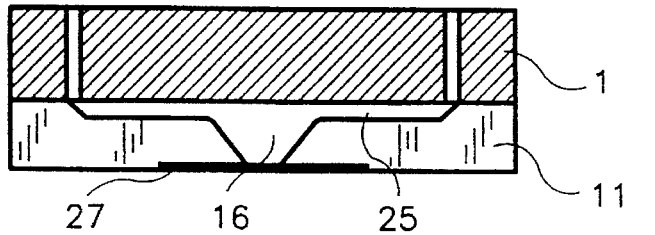
FIG. 9 is a schematic sectional view through a joined chip and or cover plate unit with recesses in the chip.

The chip 11, produced according to one of the embodiments according to FIGS. 5, 6, 7 or 10, is then joined with a cover plate 1 by anodic bonding according to FIG. 9. The cover plate 1 exhibits openings 2, where the openings 2 terminate on the chip side in the region of the recess openings 25. The recess openings 25 are connected to the ink channel 16, where the ink channel 16 is formed up to the etching stop layer 27.

Figure 8:
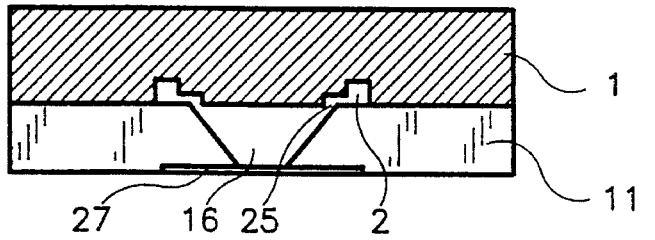
FIG. 8 is a schematic sectional view through a joined chip and cover plate unit with recesses in the cover plate.

A further embodiment of the invention is shown in FIG. 8. A chip 11, prepared according to FIG. 2, is joined by anodic bonding with a cover plate 1. The cover plate 1 exhibits openings 2, where the openings 2 are continued into the recess openings 25 for each ink channel 16, and where the openings 2 are covered by the surface of the chip 11. The recess openings 25 are fabricated by saw-cuts into the cover plate 1 made of glass, and the recess openings 25 are in part covered by the surface of the chip 11, and the recess openings 25 supply all ink channels 16.

Figure 11:
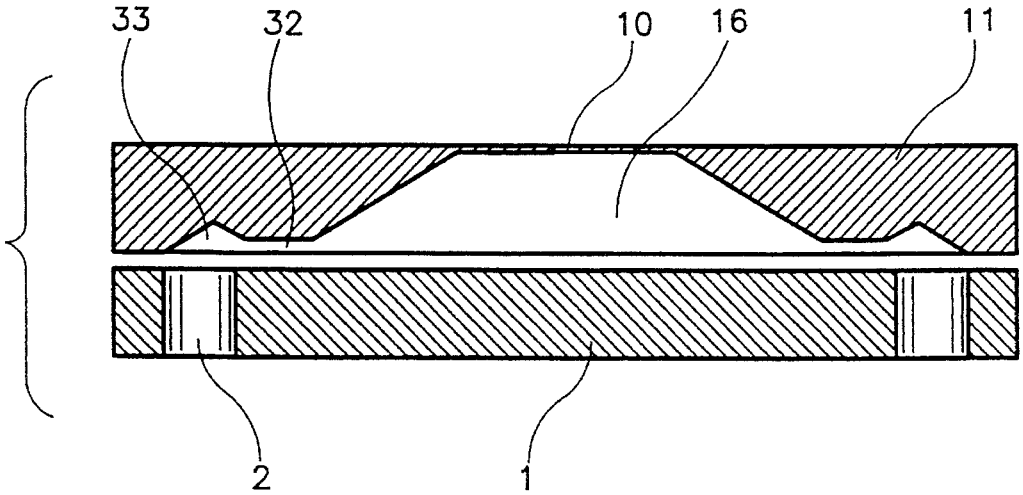
FIG. 11 is a further schematic sectional view through a chip and cover plate.
Figure 12:
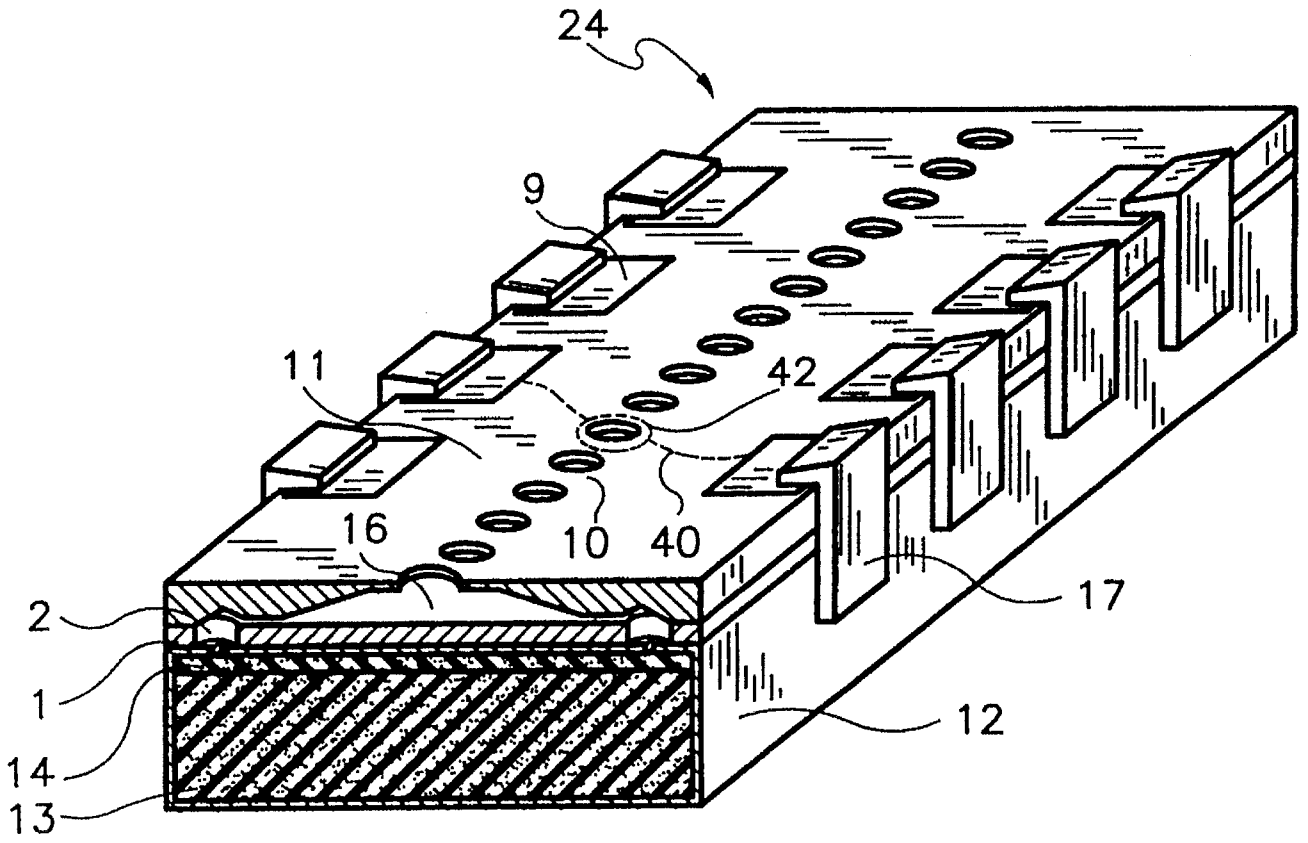
FIG. 12 is a schematic perspective view of a structure of an ink jet print head which includes a structure of a layer according to FIG. 11.
Figure 13:
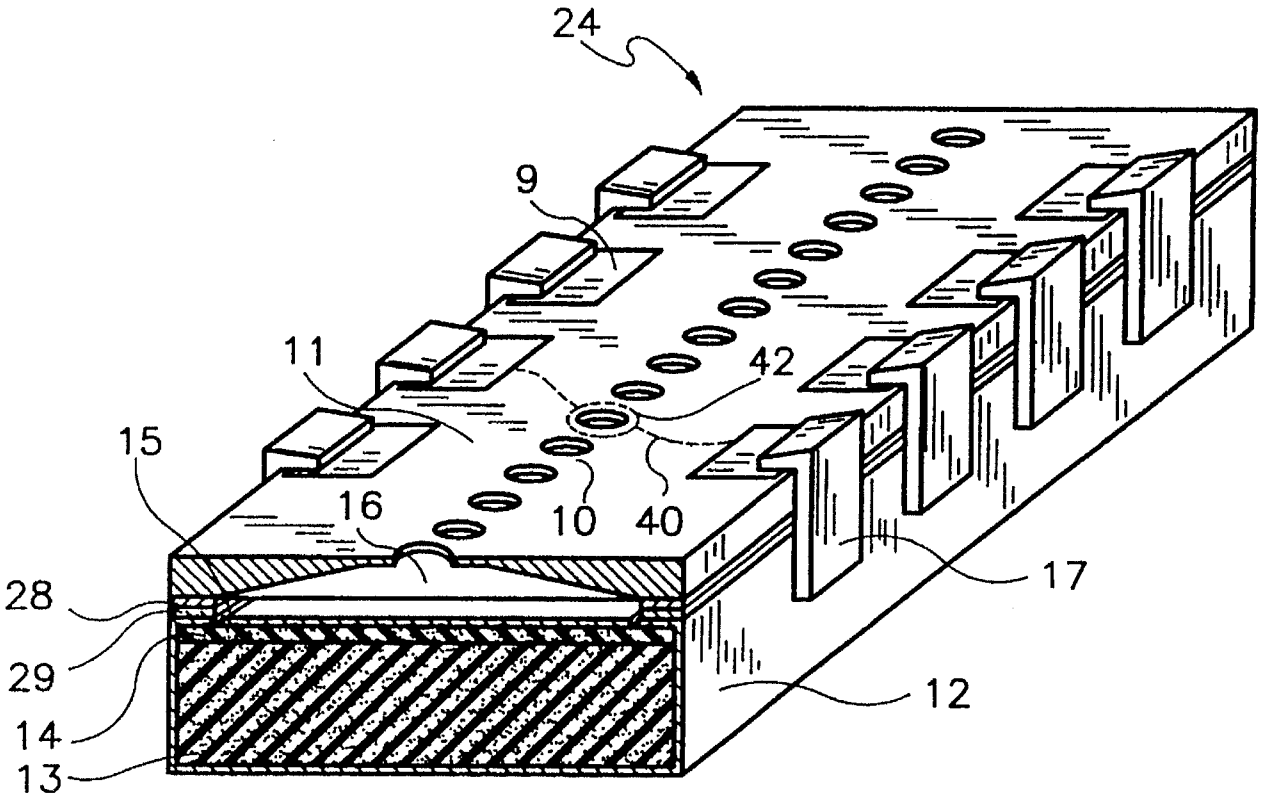
FIG. 13 is a schematic perspective view of a structure of an ink jet print head which includes a structure of a layer as an etching mask according to FIG. 5*c*.

According to a further embodiment of the invention, according to FIG. 11, each ink channel 16 is expanded on two sides of its longitudinal extension by a region 33, formed substantially as a triangle. The region 33 is in each case connected to the respective ink channel 16 with a space element of small cross-section, designated as a throttle 32. The throttles 32 and the regions 33 are structured like the ink channels 16 in the chip 11. The chip 11 is covered on the side of the ink-storage container by a cover plate 1. The cover plate 1 exhibits openings 2, where the openings 2 are coordinated to the supply channels 15 as well as to the expanded regions 33. The throttles 32 are covered with the cover plate 1. The extent of the throttling effect is determined by the cross-section of the throttles 32.

It will be understood that each of the elements described above, or two or more together, may also find a useful application in other types of print heads differing from the types described above.

While the invention has been illustrated and described as embodied in the context of a system for an electrothermal ink jet print head storage, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A system for an electrothermal ink jet print head comprising a chip including a plurality of ink channels disposed on the chip, a plurality of flow throttle structures of a defined cross-section, with each one of the plurality of flow throttle structures having a first end and having a second end, wherein the first end of each flow throttle structure of the plurality of flow throttle structures is connected to a respective one of the plurality of ink channels, and wherein a throughput of the flow throttle structure is determined by the number and size of passage openings of the flow throttle structure, a plurality of heating elements disposed in the chip for transferring heat to an ink liquid for forming electrothermally generated vapor bubbles in the ink liquid, a plurality of electrical feed lines disposed on the chip and each one of the plurality of electrical feed lines connected to a corresponding one of the plurality of heating elements, a plurality of contact terminal locations disposed on the chip and each one of the plurality of contact terminal locations connected to a corresponding one of the plurality of electrical feed lines, a plurality of ink-ejection openings disposed on the chip, wherein each one of the plurality of ink-ejection openings is connected to a corresponding one of the plurality of ink channels and wherein each electrothermally generated vapor bubble formed by a thermal transfer from a respective one of the plurality of heating elements expands in a direction opposite to an ink-ejection direction, an ink-storage container detachably connected to the chip, where a top side of the ink-storage container is disposed toward the chip, and including a supply channel formed in the surface of the ink-storage container, wherein the supply channel is connected to the second end of each flow throttle structure of the plurality of flow throttle structures, a material layer disposed between the chip and the ink-storage container, and wherein each one of the plurality of the flow throttle structures is formed as a longitudinally extended channel on each side of said ink channel furnished in the chip and covered by the material layer, thereby forming a layer construction for the electrothermal ink jet print head.

2. The system according to claim 1, wherein the ink storage container includes a second supply channel disposed substantially parallel to the first supply channel.

3. The system according to claim 1, wherein the material layer is a perforated etching mask, and wherein etch-mask openings are formed in the etching mask.

4. The system according to claim 1, wherein the chip is made of silicon, wherein the chip further includes an etching mask for forming the ink channels, wherein the etching mask includes a plurality of etch-mask openings for each ink channel, wherein the etch-mask openings give an etching agent access to the chip during the etching process, and wherein at least a part of the etch-mask openings belonging to one ink channel is disposed in the region of the ink-storage container.

5. The system according to claim 1, wherein the material layer is a cover plate furnished with openings, and wherein the openings are coordinated and connected to the supply channels.

6. The system according to claim 5, wherein the surface of the cover plate comprises a material selected from the group consisting of glass and silicon.

7. The system according to claim 1, wherein the plurality of ink channels and a plurality of connections between respective ones of the plurality of flow throttle structures and the supply channel are etched in the chip made substantially of silicon.

8. The system according to claim 1, wherein the ink channel is formed by parallel walls with inclined discharge zones, and wherein the ink channel is closed like a membrane on the side of a nozzle only by a thin layer of a chip substrate material with the ink-ejection opening furnished in this membrane.

9. The system according to claim 1, wherein the ink channel is formed by parallel walls defining a trapezoidal space in between, with a longer base of the trapezoidal space delimited by the material layer and adjoined by the supply channel, and wherein a respective one of the ink-ejection openings is formed at a shorter base of the trapezoidal space.

10. A system for an electrothermal ink jet print head comprising a chip having a plurality of ink channels, wherein each ink channel of the plurality of ink channels has a trapezoid-shaped cross-section in longitudinal direction and has an ink-ejection opening, a plurality of flow throttle structures of a defined cross-section, with each flow throttle structure of the plurality of flow throttle structures having a first end and having a second end, wherein the first end of each flow throttle structure of the plurality of flow throttle structures is connected to a respective ink channel of the plurality of ink channels, and wherein a throughput of each flow throttle structure is determined by the number and size of passage openings of said flow throttle structure of the plurality of flow throttle structures, an ink-storage container detachably connected to the chip, where a top side of the ink-storage container is disposed toward the chip, and including a supply channel formed in the surface of the ink-storage container, wherein the supply channel is connected to the second end of each flow throttle structure of the plurality of flow throttle structures, and wherein each flow throttle structure reduces and delimits the throughput, thereby generating a high pressure peak in an ink channel in which a vapor bubble is formed, a material layer disposed between the chip and the ink-storage container, wherein each one of the plurality of flow throttle structures is formed as a longitudinally extended channel on each side of said ink channel furnished in the chip and covered by the material layer, thereby forming a layer construction for the electrothermal ink jet print head.

11. The system according to claim 10, wherein the chip is made of silicon, wherein the material layer is an etching mask, wherein the etching mask has etch-mask openings for each ink channel, wherein the etch-mask openings give an etching agent access to the chip during the etching process, and wherein at least one of the etch-mask openings belonging to one ink channel is disposed in the region of the supply channel.

* * * * *